US005536884A

United States Patent [19]

Stoeckigt et al.

[11] Patent Number: 5,536,884

[45] Date of Patent: Jul. 16, 1996

[54] MIXTURE OF AT LEAST TWO ALKOXYLATED ALCOHOLS AND USE THEREOF AS A FOAM-SUPPRESSING SURFACTANT ADDITAMENT IN CLEANING COMPOSITIONS FOR MECHANIZED CLEANING PROCESSES

[75] Inventors: Dieter Stoeckigt, Ludwigshafen; Richard Baur, Mutterstadt; Horst Trapp, Plankstadt; Johannes Perner, Neustadt, all of Germany

[73] Assignee: BASF Aktiengesellschaft, Ludwigshafen, Germany

[21] Appl. No.: 104,164

[22] PCT Filed: Feb. 11, 1992

[86] PCT No.: PCT/EP92/00289

§ 371 Date: Aug. 23, 1993

§ 102(e) Date: Aug. 23, 1993

[87] PCT Pub. No.: WO92/14808

PCT Pub. Date: Sep. 3, 1992

[30] Foreign Application Priority Data

Feb. 22, 1991 [DE] Germany ..... 41 05 602.7

[51] Int. Cl.[6] ..... C11D 1/722; C11D 1/825

[52] U.S. Cl. ..... 510/514; 252/321; 252/358; 568/618; 568/625; 510/218; 510/219; 510/220; 510/234; 510/506

[58] Field of Search ..... 568/618, 625; 252/321, 358, 135, 174.21

[56] References Cited

U.S. PATENT DOCUMENTS 4,280,919 7/1981 Stoeckigt et al. ..... 252/135
4,303,544 12/1981 Kosswig et al. ..... 252/174.21
4,340,766 7/1982 Klahr et al. ..... 568/625
4,624,803 11/1986 Balzer et al. ..... 252/527
4,780,237 10/1988 Schmid et al. ..... 252/174.27

FOREIGN PATENT DOCUMENTS 0343503 11/1989 European Pat. Off. .

OTHER PUBLICATIONS

Tenside Detergents, vol. 19, No. 3, 1982, Von G. de Goederen: "Die Technologie Des Maschinellen Geschirrspulens In Haushalts– Und Gewerblichen Maschinew", pp. 123–126.

Ullmanns Encyklopadie der Technischen Chemie, 4th Edition, vol. 20, 1981, Radionuklide bis Schutzgase, pp. 147–156.

Chemical Abstracts, vol. 95, No. 5, Columbus, Ohio, USA, 1981, abstract No. 82812, "Detergent Compositions", p. 95; & JP, A, 8, 147497 (Mitsubishi Petrochemical), 30 Apr. 1981.

*Primary Examiner*—Richard L. Raymond
*Attorney, Agent, or Firm*—Oblon, Spivak, McClelland, Maier, & Neustadt

[57] ABSTRACT

A mixture suitable for use as a foam-suppressing surfactant additament in cleaning compositions for mechanized cleaning processes comprises at least two mixtures of alkoxylated alcohols I $$R—O—(C_2H_4O)_x—(C_3H_6O)_y—H \quad (I)$$

where x is an average degree of ethoxylation between 1 and 12, y is an average degree of propoxylation between 1 and 15, one alkoxylated alcohol mixture carries straight-chain or branched $C_8$–$C_{18}$-alkyl groups as the radical R and one other alkoxylated alcohol mixture carries straight-chain or branched $C_{10}$–$C_{20}$-alkyl groups as the radical R, subject to the proviso that the two radicals R differ by at least 0.5 in the average number of carbon atoms, and the two alkoxylated alcohol mixtures present in a ratio of from 10:90 to 90:10.

13 Claims, No Drawings

MIXTURE OF AT LEAST TWO ALKOXYLATED ALCOHOLS AND USE THEREOF AS A FOAM-SUPPRESSING SURFACTANT ADDITAMENT IN CLEANING COMPOSITIONS FOR MECHANIZED CLEANING PROCESSES

This application is a 371 of PCT/EP92/00289, filed Feb. 11, 1992.

DESCRIPTION

The present invention relates to process for preparing a mixture of alkoxylated alcohols of the general formula I $$R—O—(C_2H_4O)_x—(C_3H_6O)_y—H \quad (I)$$

where x is an average degree of ethoxylation of from 1 to 12, y is an average degree of ethoxylation of from 1 to 15, In the present invention, one alkoxylated alcohol mixture carries a straight-chain or branched $C_8$–$C_{18}$-alkyl group as the radical R and one other alkoxylated alcohol mixture carries a straight-chain or branched $C_{10}$–$C_{20}$-alkyl group as the radical R, subject to the proviso that the two radicals R in each of the mixtures differ by at least 0.5 in the average number of carbon atoms, and the two mixtures of alkoxylated alcohols are present in a ratio of from 10:90 to 90:10.

The present invention also relates to the use of this mixture as a foam-suppressing surfactant additament in cleaning compositions for mechanized cleaning processes. It further relates to cleaning compositions comprising such mixtures of alkoxylated alcohols I.

It is known from practical experience that in mechanized cleaning processes, for example in mechanized dishwashing, it is in general necessary to carry out two successive cleaning cycles, usually separated by an intermediate rinse cycle with water using different cleaning compositions. The actual cleaning liquor comprises alkaline agents for detaching and emulsifying, for example, food residues. The after- or final-rinse liquor, by contrast, comprises specific final rinse compositions for a clear, spot- and streak-free surface, for example on dishes. These compositions must have a good wetting effect so that the rinse water may run off the surface as a film and not leave visible residues, and be readily dispersible in water. Owing to the high degree of liquor agitation in the cleaning and rinsing machines used here, final rinse compositions also must be sufficiently low-foam.

Compositions agents of this type are known in large numbers; examples are wetting agents such as ethylene and/or propylene oxide adducts with alcohols, phenols or amines.

For instance, EP-A-034 275 (1) relates to the use of nonionic surfactants obtained by reacting at least one $C_8$–$C_{20}$-alkanol ethoxylate (4–14 EO) with 1,2-butylene oxide in a molar ratio of from 1:1.6 to 1:2.4 in biodegradable and low-foaming cleaning and rinsing compositions.

EP-A-161 537 (2) concerns the use of methyl-, ethyl- or allyl-tipped nonionic surfactants obtainable by stepwise alkoxylation of $C_8$–$C_{22}$-alkanols with at least two different alkylene oxides as low-foam, foam-suppressing and biodegradable surfactants in industrial cleaning processes.

EP-B-019 173 (3) concerns the use of $C_9$–$C_{18}$-alkanols reacted first with propylene oxide and then with ethylene oxide as low-foam and biodegradable surfactant additaments in dishwashing compositions for dishwashers.

Surfactants of the type mentioned and also mixtures thereof, however, prove to be still in need of improvement when used in cleaning compositions for mechanized cleaning processes. Especially the foam suppression characteristics and the dispersibility in water are still not optimal.

It is an object of the present invention to remedy the above-described defects of the prior art.

We have found that this object is achieved by the above-defined process for preparing a mixture of alkoxylated alcohols I, which comprises mixing at least two mixtures of alcohols of the general formula $$R—O—H$$

where one alcohol mixture carries straight-chain or branched $C_8$–$C_{18}$-alkyl groups as the radical R and one other alcohol mixture carries straight-chain or branched $C_{10}$–$C_{20}$-alkyl groups as the radical R, subject to the proviso that the two radicals R differ by at least 0.5 in the average number of carbon atoms, and the two alcohol mixtures are present in a weight ratio of from 10:90 to 90:10, with one another and reacting this mixture first with the corresponding amount of ethylene oxide and then with the corresponding amount of propylene oxide, and the use of such a mixture as a foam-suppressing surfactant additamant in cleaning compositions for mechanized cleaning processes.

As straight-chain or branched $C_8$–$C_{18}$- and $C_{10}$–$C_{20}$-alkyl radicals R there may be mentioned for example: n-octyl, 2-ethylhexyl, n-nonyl, isononyl, n-decyl, isodecyl, n-undecyl, n-dodecyl, n-tridecyl, isotridecyl, n-tetradecyl, n-pentadecyl, n-hexadecyl, n-heptadecyl, n-octadecyl and n-eicosyl. The radicals R are preferably straight-chain or only slightly branched; that is, they contain not more than 3 methyl or ethyl side chains.

Depending on the origin of the alkanol used in the synthesis of the compounds I, R is a radical of a naturally occurring fatty alcohol or preferably of a synthetically produced oxo or Ziegler alcohol. Examples of readily usable alcohols produced by the oxo process are $C_9/C_{11}$-, $C_{12}/C_{14}$-, $C_{13}/C_{15}$- and $C_{16}/C_{18}$-alkanol mixtures. Examples of readily usable alcohols produced by the Ziegler process are $C_8/C_{10}$-, $C_{10}/C_{12}$-, $C_{12}/C_{14}$-, $C_{12}/C_{16}$- and $C_{16}/C_{20}$-alkanol mixtures.

Since the alkanols used in the synthesis of the compounds I are in general random homolog mixtures and even isomer mixtures, it is advisable to speak of an average number of carbon atoms. This average value will usually be the most frequently occurring value.

The alkoxylated alcohols I are advantageously prepared in a conventional manner by ethoxylation and subsequent propoxylation of the alkanols mentioned. These processes are known to the person skilled in the art and do not need to be more particularly described herein.

The degree of ethoxylation x is from 1 to 12, preferably from 2 to 5, in particular from 3 to 4; the degree of propoxylation is from 1 to 15, preferably from 2 to 6, in particular from 4 to 6. The degrees of alkoxylation x and y are in general likewise average values.

The mixture used comprises at least two, preferably two or three, in particular two, mixture of alcohols of the formula R—O—H in which two radicals R have to differ by at least 0.5 in the average number of carbon atoms, the corresponding two alcohol mixtures being present in a ratio of from 10:90 to 90:10, preferably from 25:75 to 75:25. It is of particular advantage for the difference in the average number of carbon atoms of the two radicals R to be at least 1, in particular from 1 to 2.

Mechanized cleaning processes are chiefly found in the metal industry, in the food industry (for example the beverage, canned food or sugar industry or the milk-, meat- and fat-processing industry) in the catering trade and even in the home. For instance, metal articles frequently have to be cleaned after they have been made or processed to remove impurities and residues of, for example, drawing and rolling greases or organic corrosion inhibitors. All surfaces of containers and processing machines which come into contact with a food in the course of production and further processing and in transport have to be cleaned at certain intervals to remove food residues and other soiling. A typical example of an industrial mechanized cleaning process from the beverage industry is the washing of used bottles which contained, for example, beer, milk, refreshments or mineral water.

Of particular importance is the use according to the invention of the designated mixture of alkoxylated alcohols I in the mechanized dishwashing in the home, in catering businesses and in industry. Here the mixtures mentioned are used to outstanding effect, in particular as foam-suppressing surfactant additaments in final rinse compositions for mechanized dishwashing.

Further details concerning the technology of mechanized dishwashing and the composition of cleaning and final rinse compositions used for that purpose are found for example in Tenside Detergents 19 (1982), 123–126, (4), or Ullmanns Encyklopädie der technischen Chemie, 4th edition, volume 20 (1981), pages 149–150, (5).

According to these references, a customary final rinse composition comprises nonionic surfactants, hydrotropes (solubilizers) such as isopropanol, ethanol and/or cumene sulfonate, water and optionally organic or inorganic acids and assistants, such as dyes and preservatives.

The present invention also provides a process for preparing cleaning compositions for mechanized cleaning processes, in particular final rinse compositions for mechanized dishwashing, which comprises incorporating in these compositions a foam-suppressing surfactant additament comprising a mixture of alkoxylated alcohols I.

The present invention further provides cleaning compositions for mechanized cleaning processes comprising a mixture of alkoxylated alcohols I as a foam-suppressing surfactant additament in an amount of from 0.1 to 40% by weight, preferably from 0.5 to 20% by weight, based on the total amount of the formulation.

The present invention further provides final rinse compositions for mechanized dishwashing comprising a mixture of alkoxylated alcohols I as a foam-suppressing surfactant additament in an amount of from 0.5 to 30% by weight, preferably from 1 to 15% by weight, based on the total amount of the formulation.

The mixture of alkoxylated alcohols I according to the invention represents an optimum of the properties desired for cleaning the hard surfaces mentioned, for example metal or crockery, namely good wetting power, streak-free runoff from the rinsed stock, foam suppression or absence of foam, and good dispersibility in water. It is also an advantage that the defined mixture of the compounds I is readily biodegradable.

EXAMPLES

Example 1

Preparation of a mixture of alkoxylated oxo alcohols

An autoclave was charged with 100 g of a $C_{12}/C_{14}$-oxo alcohol having on average 13 carbon atoms (corresponding to 0.5 mol) and 107 g of a $C_{13}/C_{15}$-oxo alcohol having on average 14 carbon atoms (corresponding to 0.5 mol) together with 0.2 g of potassium hydroxide as an alkoxylation catalyst. 154 g of ethylene oxide (corresponding to 3.5 mol) were injected continuously at from 110° to 120° C. To complete the reaction, the contents were subsequently stirred for 1 hour at the same temperature. Then 319 g of propylene oxide (corresponding to 5.5 mol) were added continuously at from 130° to 140° C. The contents were subsequently allowed to react at that temperature for 2 hours.

The result was 680 g of a mixture of the alkoxylated oxo alcohols having an OH number of 83 and a cloud point of 32° C., measured in butyldiglycol in accordance with DIN 53 917.

Application properties

To measure the application properties, final rinse formulations for mechanized dishwashing in the home were prepared. The table below shows the compositions of these formulations.

To characterize the formulations, the cloud points of the formulations, the foam suppression behavior in the dishwasher and the dispersibility in hot water were determined.

The cloud point was determined in accordance with DIN 53 917. It is known from practical studies that decreasing cloud points, equivalent to an increase in the hydrophobicity, result in improvements in the foaming characteristics, but also in reductions in dispersibility, which leads to nonuniform distribution of the final rinse in the rinse liquor and hence to impairment of the runoff characteristics (spotting, smudging and streaking). At cloud points <40° C., moreover, instability, ie. phase separation, of the final rinse formulation is observed.

The foam suppression behavior is tested in the dishwasher using the so-called "egg test". Magnetic induction measurement is used in a commercial domestic dishwashing machine to determine the number of revolutions of a spraying arm with the aid of a counter. Foaming, which occurs in particular in the presence of proteins (egg white), reduces the speed of the arm. Thus, the number of revolutions per minute, because of the reduced thrust, represents a measure of the suitability of surfactants for use in high-agitation cleaning equipment. The test time is 12 minutes, over which the average number of revolutions per minute is calculated from the total number of revolutions. The wash is started at room temperature, but after about 10 minutes the temperature of the wash liquor is 60° C.

To assess the dispersibility, the final rinse formulation is injected by means of a membrane pump into a glass tube through which hot tap water at 90° C. flows. At the end of the glass tube, the dispersion thus produced is sprayed through a second nozzle into a glass beaker. In the course of about 3.5 min about 30 ml of final rinse formulation are metered into a stream of 2 liters of water at 90° C. The dispersion is visually assessed and rated in the glass tube and in the glass beaker on the basis of the following scheme:

A rating of 1 indicates: no dispersion, product floats on top (large drops>5 mm)

A rating of 2 indicates: incipient dispersion in the glass tube, smaller drops (2–3 mm) in the beaker A rating of 3 indicates: moderate dispersion in the glass tube, moderate dispersion in the beaker (fine droplets of about 1 mm)

A rating of 4 indicates: good dispersion in the tube, fine dispersion in the beaker (droplets<0.5 mm)

A rating of 5 indicates: very fine dispersion in the glass tube and in the beaker.

The results of the measurements are reproduced in the following table:

TABLE

Composition, cloud point, dishwasher speed and dispersibility of final rinse formulations

| Composition of formulation [% by weight] | Example No. 2 | 3 | 4 | 5 | 6 | 7 |
|---|---|---|---|---|---|---|
| Surfactant A | 10 | 10 | 15 | 10 | 15 | 15 |
| Surfactant B | 10 | | 5 | | | |
| Surfactant C | | 10 | | | | 5 |
| Mixture of Example 1 | | | | 10 | 5 | |
| Ethanol | 2 | 2 | 2 | 2 | 2 | 2 |
| Cumenesulfonate | 3 | 3 | 3 | 3 | 3 | 3 |
| Water | 75 | 75 | 75 | 75 | 75 | 75 |
| Cloud point [°C.] | 45 | 43.5 | 50 | 36 | 47 | 44 |
| Dishwasher speed [rpm] | 112 | 114 | 108 | 118 | 115 | 110 |
| Dispersibility [rating] | 4–5 | 2 | 4–5 | 4–5 | 4–5 | 2 |

Prior art formulation:
Surfactant A: $C_{13}/C_{15}$-oxo alcohol + 11 mol of ethylene oxide + 2 mol of butylene oxide as per (1)
Surfactant B: $C_9/C_{11}$-oxo alcohol + 7 mol of ethylene oxide + 1 mol of butylene oxide + methyl tipping as per (2)
Surfactant C: $C_{13}/C_{15}$-oxo alcohol + 4 mol of propylene oxide + 2 mol of ethylene oxide as per (3)

The above Examples reveal that using the surfactant additaments according to the invention (Examples 5 and 6) gives final rinse formulations which combine excellent foam suppression characteristics with excellent dispersibility, notwithstanding an occasionally very low cloud point (Example 5). It is true that the lowering of the cloud point due to the addition of a hydrophobic surfactant frequently leads to improved foam suppression, but at the same time to the loss of the dispersing properties. Solubilizers are usually added to push the cloud point back up again and improve the dispersibility. Example 5 shows that the addition of the defined mixtures of compounds I makes it possible to dispense partly or entirely with solubilizers for raising the cloud point.

Comparative Examples 2, 3, 4 and 7 show how the addition or mixing of known agents of the prior art does improve foam suppression somewhat, but it also reduces the dispersibility as a result of lowering the cloud point.

We claim:

1. A composition of alkoxylated alcohols of the general formula I $$R—O—(C_2H_4O)_x—(C_3H_6O)_y—H \qquad I$$

where x is an average degree of ethoxylation of from 1 to 12 and y is an average degree of propoxylation of from 1 to 15, prepared by a process which comprises mixing at least a first mixture of alcohols and a second mixture of alcohols, each of said first and second mixtures of alcohols being of the general formula $$R—O—H$$

where said first mixture of alcohols carries straight-chain or branched $C_8$–$C_{18}$-alkyl groups as the radical R and said second mixture of alcohols carries straight-chain or branched $C_{10}$–$C_{20}$-alkyl groups as the radical R, subject to the proviso that the radicals R in said first mixture of alcohols differ by at least 0.5 in the average number of carbon atoms from the radicals R in said second mixture of alcohols, and said first mixture of alcohols and second mixture of alcohols are present in a weight ratio of from 10:90 to 90:10, and reacting the product of said mixing step first with the corresponding amount of ethylene oxide and then with the corresponding amount of propylene oxide.

2. The composition of claim 1, wherein said average degree of ethyoxylation x is from 2 to 5 and said average degree of propoxylation y is from 2 to 6.

3. The composition of claim 1, wherein said first mixture is selected from the group consisting of $C_9/C_{11}$ oxo alcohols, $C_{12}/C_{14}$ oxo alcohols, $C_{13}/C_{15}$ oxo alcohols, $C_{16}/C_{18}$ oxo alcohols, $C_8/C_{10}$ Ziegler alcohols, $C_{10}/C_{12}$ Ziegler alcohols, $C_{12}/C_{14}$ Ziegler alcohols and $C_{12}/C_{16}$ Ziegler alcohols, and said second mixture is selected from the group consisting of $C_{12}/C_{14}$ oxo alcohols, $C_{13}/C_{15}$ oxo alcohols, $C_{16}/C_{18}$ oxo alcohols, $C_{10}/C_{12}$ Ziegler alcohols, $C_{12}/C_{14}$ Ziegler alcohols, $C_{12}/C_{16}$ Ziegler alcohols and $C_{16}/C_{20}$ Ziegler alcohols, subject to the proviso that the radicals R in said first mixture of alcohols differ by at least 0.5 in the average number of carbon atoms from the radicals R in said second mixture of alcohols.

4. The composition of claim 1 or 2, wherein said first mixture and said second mixture are present in a weight ratio of from 25:75 to 75:25.

5. The composition of claim 1 or 2, wherein said first mixture of alcohols is a $C_{12}/C_{14}$ oxo alcohol and said second mixture is a $C_{13}/C_{15}$ oxo alcohol.

6. A process for preparing a composition of alkoxylated alcohols of the general formula I $$R—O—(C_2H_4O)_x—(C_3H_6O)_y—H \qquad I$$

where x is an average degree of ethoxylation of from 1 to 12 and y is an average degree of propoxylation of from 1 to 15, which comprises mixing at least a first mixture of alcohols and a second mixture of alcohols, each of said first and second mixtures of alcohols being of the general formula $$R—O—H$$

where said first mixture of alcohols carries straight-chain or branched $C_8$–$C_{18}$-alkyl groups as the radical R and said second mixture of alcohols carries straight-chain or branched $C_{10}$–$C_{20}$-alkyl groups as the radical R, subject to the proviso that the radicals R in said first mixture of alcohols differ by at least 0.5 in the average number of carbon atoms from the radicals R in said second mixture of alcohols, and said first mixture of alcohols and second mixture of alcohols are present in a weight ratio of from 10:90 to 90:10, with one another and reacting the product of said mixing step first with the corresponding amount of ethylene oxide and then with the corresponding amount of propylene oxide.

7. The process of claim 6 wherein said average degree of ethyoxylation x is from 2 to 5 and said average degree of propoxylation y is from 2 to 6.

8. The process as claimed in claim 1 or 2, wherein said first mixture of alcohols is a $C_{12}/C_{14}$ oxo alcohol and said second mixture is a $C_{13}/C_{15}$ oxo alcohol.

9. The process of claim 6, wherein said first mixture is selected from the group consisting of $C_9/C_{11}$ oxo alcohols, $C_{12}/C_{14}$ oxo alcohols, $C_{13}/C_{15}$ oxo alcohols, $C_{16}/C_{18}$ oxo alcohols, $C_8/C_{10}$ Ziegler alcohols, $C_{10}/C_{12}$ Ziegler alcohols, $C_{12}/C_{14}$ Ziegler alcohols and $C_{12}/C_{16}$ Ziegler alcohols, and said second mixture is selected from the group consisting of $C_{12}/C_{14}$ oxo alcohols, $C_{13}/C_{15}$ oxo alcohols, $C_{16}/C_{18}$ oxo alcohols, $C_{10}/C_{12}$ Ziegler alcohols, $C_{12}/C_{14}$ Ziegler alcohols, $C_{12}/C_{16}$ Ziegler alcohols and $C_{16}/C_{20}$ Ziegler alcohols, subject to the proviso that the radicals R in said first mixture of alcohols differ by at least 0.5 in the average number of carbon atoms from the radicals R in said second mixture of alcohols.

10. A process for preparing a cleaning composition for a mechanized cleaning process, which comprises incorporating in said cleaning composition a foam-suppressing surfactant additament comprising the composition as set forth in claim 1 or 2.

11. A process for preparing a final rinse composition for mechanized dishwashing, which comprises incorporating in said rinse composition a foam-suppressing surfactant additament comprising the composition as set forth in claim 1 or 2.

12. A method of suppressing foam in a mechanized cleaning process, comprising adding an amount of the composition of claim 1 or 2 effective to suppress foam to a cleaning composition, and mechanically cleaning an article with said cleaning composition to which the composition of claim 1 or 2 has been added.

13. A method of suppressing foam in a mechanized dishwashing process, comprising adding an amount of the composition of claim 1 or 2 effective to suppress foam to a rinse composition, and in a mechanical dishwasher, rinsing an article with a dispersion of said rinsing composition to which the composition of claim 1 or 2 has been added.

* * * * *